US010105964B2

(12) United States Patent
Vulpe et al.

(10) Patent No.: US 10,105,964 B2
(45) Date of Patent: Oct. 23, 2018

(54) FLATBED PRINTER ASSEMBLY AND A METHOD THEREFOR

(71) Applicant: Océ Holding B.V., Venlo (NL)

(72) Inventors: Radu Vulpe, Timisoara (RO); Daniel-Samuil Voina, Timisoara (RO); Claudiu A. Dunga, Timisoara (RO)

(73) Assignee: OCÉ HOLDING B.V, Venlo (NL)

( * ) Notice: Subject to any disclaimer, the term of this patent is extended or adjusted under 35 U.S.C. 154(b) by 0 days.

(21) Appl. No.: 15/821,978

(22) Filed: Nov. 24, 2017

(65) Prior Publication Data

US 2018/0162149 A1 Jun. 14, 2018

(30) Foreign Application Priority Data

Dec. 8, 2016 (EP) ..... 16202911

(51) Int. Cl.
*B41J 3/60* (2006.01)
*B41J 3/28* (2006.01)
(Continued)

(52) U.S. Cl.
CPC . *B41J 3/28* (2013.01); *B41J 3/60* (2013.01); *B41J 11/008* (2013.01);
(Continued)

(58) Field of Classification Search
CPC ..... B41J 3/60
See application file for complete search history.

(56) References Cited

U.S. PATENT DOCUMENTS

2008/0019727 A1* 1/2008 Honma ..... B41J 3/60 399/82
2011/0211006 A1* 9/2011 Ochiai ..... B41J 3/60 347/16

FOREIGN PATENT DOCUMENTS

WO WO 2015/082510 A1 6/2015

OTHER PUBLICATIONS

European Search Report issued in European Application No. 16 20 2911, dated May 16, 2017.

* cited by examiner

*Primary Examiner* — Julian D Huffman
(74) *Attorney, Agent, or Firm* — Birch, Stewart, Kolasch & Birch, LLP

(57) ABSTRACT

A flatbed printer assembly includes a controller for controlling the movements of a gantry, a carriage support and the print head while moving over a medium support table. The controller is configured to receive a print job including a cut path intended to circumvent a piece of the recording medium, a first image intended to be printed on a front side of the piece of the recording medium, a second image intended to be printed on a back side of the piece of the recording medium, wherein at least one of the first and second image is intended to be printed at least partially in a full bleed print mode. Shapes are selected for a first alignment mark for the first image and a second alignment mark for the second image. A first location is determined on the front side of the recording medium according to the selected shape of the first alignment mark. The first location crosses the cut path. A second location on the back side of the recording medium is determined according to the selected shape of the second alignment mark. The second location crosses the cut path. A first sub-image is extracted from the first image which is intended to be printed on the first location of the first alignment mark. A second sub-image is extracted from the second image which is intended to be printed on the second location of the second alignment mark. The first sub-image is printed at the first location as being the first alignment mark. After the recording medium is turned upside down on the medium support table, the second sub-image is printed at the second location as being the second alignment mark.

10 Claims, 9 Drawing Sheets

(51) Int. Cl.
*B41J 11/00* (2006.01)
*B41J 11/66* (2006.01)
*B41J 13/00* (2006.01)

(52) U.S. Cl.
CPC ..... *B41J 11/0065* (2013.01); *B41J 11/663* (2013.01); *B41J 13/0063* (2013.01)

FLATBED PRINTER ASSEMBLY AND A METHOD THEREFOR

FIELD OF THE INVENTION

The present invention generally pertains to a flatbed printer assembly, the flatbed printer assembly comprising a medium support table for supporting a recording medium, the table extending in a first direction and a second direction, the first direction being perpendicular to the second direction, a gantry arranged to be moveable over the medium support table in the first direction, a carriage support movably arranged on the gantry to move over the medium support table in the second direction, a carriage configured to be coupled to the carriage support and comprising a print head to eject marking material on the recording medium, and a controller for controlling the movements of the gantry, the carriage support and the print head while moving over the medium support table.

BACKGROUND ART

A flatbed printer assembly is known in the art, for example a flatbed printer assembly as disclosed in patent application WO 2015/082510. Such a known printer assembly comprises a medium support table on which a recording medium may be arranged. Such a printer assembly is particular advantageous for printing on a large rigid medium. Such a rigid medium is, for example, used in the graphics arts for printing signs and posters.

A gantry is provided such that the gantry is moveable over the medium support table and a carriage is moveably supported by the gantry such that the carriage is moveable over the medium support table in a direction perpendicular to the direction of movement of the gantry. By suitably controlling a movement of the gantry and the carriage, a print head such as an inkjet print head is enabled to print digital images on both sides of the rigid medium, even from edge to edge.

A cut path may be an outline of an image intended to be printed on the rigid medium. The cut path may be located inside an image intended to be printed on the rigid medium.

The rigid medium may be printed on by means of a printing device. When one or both sides of the rigid medium comprise a printed image consisting of a marking material like ink or toner material and the rigid medium is cut by a flatbed printer assembly, printed marking material may chip off a printed side during cutting. Therefore usually the rigid medium is cut before printing so that the marking material does not chip off.

Hereinafter a piece of the recording medium is meant to be a piece of the recording medium that is cut out of the complete recording medium. The remainder of the recording medium which is left when the piece of recording medium is cut out is hereinafter called a jig.

By first cutting the rigid medium and printing the images on both sides, another problem arises of aligning the front and back printed images and aligning is time consuming especially when a plurality of media have to be aligned. The recording medium itself may be also aligned on the flatbed support table with a corner of the recording medium to a corner or construction point of the flatbed support table.

Adding alignment marks on the jig and on the piece of the recording medium is affecting the print quality of the printed images due to the fact that the alignment mark ends up under the printed image.

It is desirable to have a flatbed printer assembly that is enabled and configured to print images on a piece of a recording medium cut out of the recording medium and to ease aligning a front and back image to be printed on the piece of recording medium.

SUMMARY OF THE INVENTION

In an aspect of the present invention, a flatbed printer assembly is provided wherein the controller is configured to a) receive a print job including a cut path intended to circumvent a piece of the recording medium, a first image intended to be printed on a front side of the piece of the recording medium, a second image intended to be printed on a back side of the piece of the recording medium, wherein at least one of the first and second image is intended to be printed at least partially in a full bleed print mode,
b) select a shape for a first alignment mark for the first image,
c) select a shape for a second alignment mark for the second image,
d) determine a first location on the front side of the recording medium according to the selected shape of the first alignment mark, the first location crossing the cut path,
e) determine a second location on the back side of the recording medium according to the selected shape of the second alignment mark, the second location crossing the cut path,
f) extract a first sub-image from the first image which is intended to be printed on the first location of the first alignment mark,
g) extract a second sub-image from the second image which is intended to be printed on the second location of the second alignment mark,
h) print the first sub-image at the first location as being the first alignment mark,
i) receive a trigger that the recording medium is turned upside down on the medium support table,
j) print the second sub-image at the second location as being the second alignment mark,
k) cut the recording medium along the cut path, and
l) print the first image on the front side of the piece of the recording medium and the second image on the back side of the piece of the recording medium.

By extracting the first and second sub-image from the first and second image respectively, the first and second printed alignment marks do not have to end up under the printed first and second image since they are in pair with the first and second image and after cutting the recording medium along the cut path the first and second image may be printed except for the first and second sub-image respectively.

According to an embodiment the flatbed printer assembly comprises a user interface and the controller is configured to request permission to execute steps b)-j) by means of user interaction via the user interface.

The invention also relates to a method for printing on a recording medium by a flatbed printer assembly, the flatbed printer assembly comprising a medium support table for supporting the recording medium, the table extending in a first direction and a second direction, the first direction being perpendicular to the second direction, a gantry arranged to be moveable over the medium support table in the first direction, a carriage support movably arranged on the gantry to move over the medium support table in the second direction, a carriage configured to be coupled to the carriage support and comprising a print head to eject marking material on the recording medium, and a controller for controlling the movements of the gantry, the carriage support and the print head while moving over the medium support table, wherein the method comprises the steps of a) receiving a print job including a cut path intended to circumvent a piece of the recording medium, a first image intended to be printed at least partially in a full bleed print mode on a front side of the piece of the recording medium, and a second image intended to be printed at least partially in a full bleed print mode on a back side of the piece of the recording medium, b) selecting a shape for a first alignment mark for the first image, c) selecting a shape for a second alignment mark for the second image, d) determining a first location on the front side of the recording medium according to the selected shape of the first alignment mark, the first location crossing the cut path, e) determining a second location on the back side of the recording medium according to the selected shape of the second alignment mark, the second location crossing the cut path, f) extracting a first sub-image from the first image which is intended to be printed on the first location of the first alignment mark, g) extracting a second sub-image from the second image which is intended to be printed on the second location of the second alignment mark, h) printing the first sub-image at the first location as being the first alignment mark, i) receiving a trigger that the recording medium is turned upside down on the medium support table, j) printing the second sub-image at the second location as being the second alignment mark, k) cutting the recording medium along the cut path, and l) printing the first image on the front side of the piece of the recording medium and the second image on the back side of the piece of the recording medium.

According to an embodiment of the method the first and second sub-images are printed with an opacity in a percentage range from 100 percent to 10 percent.

According to an embodiment the first and second alignment marks are printed in another color with an opacity of less than 50 percent, the other color being different from the colors of the first and second sub-images.

According to an embodiment the first sub-image is completely located within the cut path, and the method comprises the step of extending the first sub-image with a third image having a shape of the first alignment mark outside the circumvented piece of the recording medium before printing the first sub-image.

According to an embodiment the second sub-image is completely located within the cut path, and the method comprises the step of extending the second sub-image with a fourth image having a shape of the second alignment mark outside the circumvented piece of the recording medium before printing the second sub-image.

According to an embodiment the method comprises the steps of, after the printing of the first and second sub-image, receiving the recording medium on the flatbed support table with the front side on top, the recording medium being cut along the cut path, aligning the piece of the recording medium with the remainder of the recording medium by means of the printed first sub-image, printing the first image on the recording medium except for the first sub-image, receiving a trigger that the recording medium is turned upside down on the medium support table, aligning the piece of the recording medium with the remainder of the recording medium by means of the printed second sub-image, and printing the second image on the recording medium except for the second sub-image.

According to an embodiment the step of printing the first image on the recording medium except for the first sub-image comprises the sub-steps of determining a percentage of opacity of the printed first sub-image, printed in step h) of the method according to the invention, and printing the first sub-image on the cut recording medium to achieve a opacity of 100 percent when printing of the first sub-image is completed, and wherein the step of printing the second image on the recording medium except for the second sub-image comprises the sub-steps of determining a percentage of opacity of the printed second sub-image, printed in step j) of the method according to the invention, and printing the second sub-image on the cut recording medium to achieve a opacity of 100 percent when printing of the second sub-image is completed.

The invention also relates to a computer-program product configured to execute a method according to the invention when executed on a processor.

The invention also relates to a non-transitory data carrier having stored thereon the computer-program product according to the invention.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinafter and the accompanying schematic drawings which are given by way of illustration only, and thus are not limitative of the present invention, and wherein.

DETAILED DESCRIPTION OF THE DRAWINGS

Figure 1:
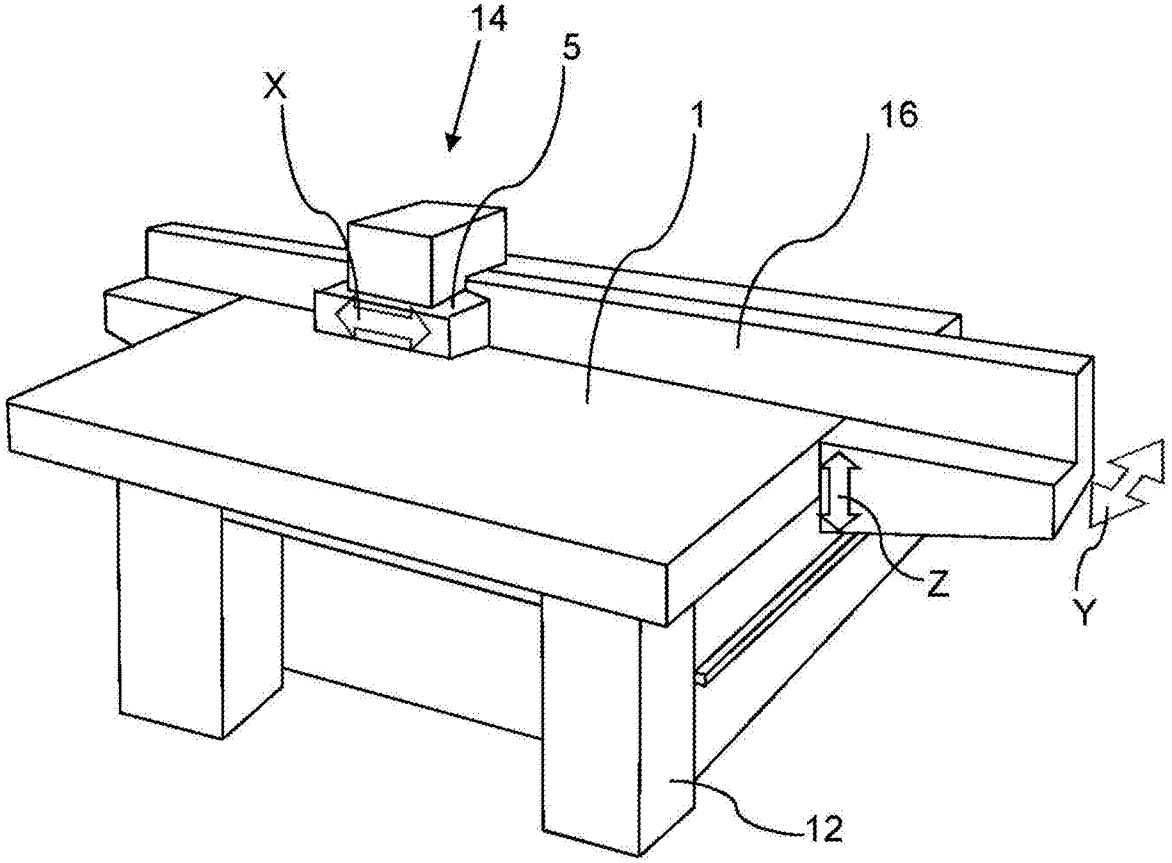
FIG. 1 is a perspective view of an embodiment of a flatbed printer assembly according to the invention.

The present invention will now be described with reference to the accompanying drawings, wherein the same reference numerals have been used to identify the same or similar elements throughout the several views.

FIG. 1 shows an embodiment of a flatbed printer assembly 14 according to the invention, in which the medium supporting means 1 is a flat surface. On the flat surface a non-flexible flat medium may be arranged and may be printed upon. The medium supporting means 1 is supported on a suitable support structure 12 and a carriage guiding assembly 16 is arranged over the medium supporting means 1. Such carriage guiding assembly 16 is also known in the art as a gantry. The carriage guiding assembly supports a printer carriage 5 such that the printer carriage 5 is enabled to scan in an X-direction. The carriage guiding assembly 16 is arranged and configured to be enabled to reciprocate in a Y-direction, wherein the Y-direction is usually substantially perpendicular to the X-direction. In a known flatbed printer assembly 14, the carriage guiding assembly 16 is also arranged and configured to be enabled to move in a Z-direction, which is substantially perpendicular to the X-direction and the Y-direction such to enable to adapt the flatbed printer assembly 14 to a thickness of the recording medium being arranged on the medium supporting surface 1. A print head (not shown) is coupled to the printer carriage 5 and comprises an accumulator to control a height in the Z-direction above the medium supporting means 1.

Sensors may be provided with the flatbed printer assembly 14 to detect a presence of a recording medium on the medium supporting means 1, an alignment of a recording medium on the medium supporting means 1 and a removal of a recording medium from the medium supporting means 1.

The controller of the flatbed printer assembly 14 may be integrated in a housing of the flatbed printer assembly 14 or may be resident in a work station digitally connected to the flatbed printer assembly 14. The controller may comprise hardware and/or software configured to instruct the printer to execute printing operations. Input for the instructions maybe a print job submitted to the controller of the flatbed printer assembly 14. The print job may specify an image per side of the recording medium, a cut path and a print mode of full bleed printing within the cut path. Full bleed printing may also be referred to as printing from edge to edge.

According to an embodiment the controller is configured to derive from the cut path whether or not the piece of recording medium which is intended to be circumvented by the cut path has at least two axes of symmetry. The more axes of symmetry the piece of recording medium intended to be cut out possesses, the more advantage the method of the invention is. When the piece of recording medium intended to be cut out of the recording medium has more than one axis of symmetry the operator may have trouble to align the cut out piece with the jig. The trouble gets worse when the number of axes of symmetry increases. For example, in case of a cut path in the form of a circle a printed image on a front side of the recording medium is difficult to align before printing the image on the back side of the recording medium when no alignment marks are used and the piece of recording medium is loose from the jig after cutting.

According to an embodiment the flatbed printer assembly 14 comprises a user interface (not shown) and the controller is configured to receive print jobs with print job properties and cutting commands via the user interface. The controller may also be configured to request permission to execute a step of the method according to the invention by means of user interaction via the user interface. According to another embodiment elementary printing instructions are provided to the controller via the user interface. The printing instructions may be entered by an operator via the user interface. The user interface may be local user interface or a remote user interface connected to the controller via a digital network.

Figure 2:
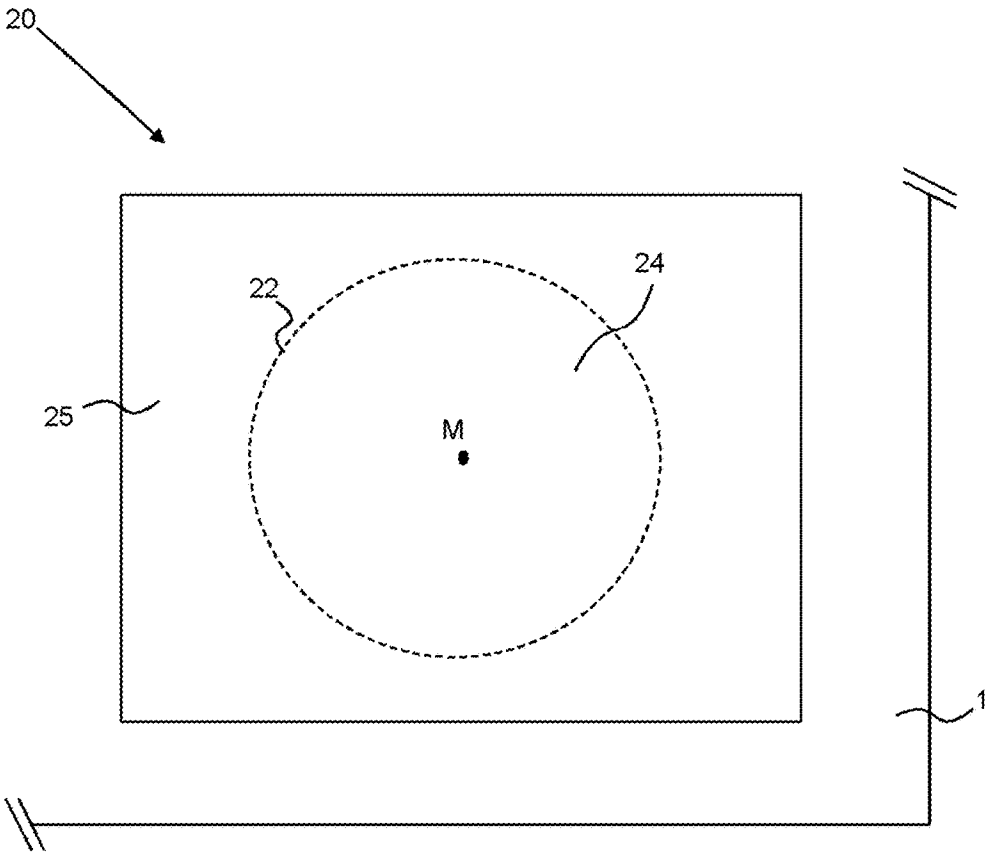
FIG. 2 is a schematic top view of a front side of a recording medium lying on the medium support table of a flatbed printer assembly according to the invention.

FIG. 2 is a schematic top view of a front side of a recording medium 20 lying on the medium support table 1 of a flatbed printer assembly 14 according to the invention. On the recording medium 20 schematically a cut path 22 is drawn with dashed lines to indicate that the recording medium is not yet cut. A piece 24 of the recording medium 20 is intended to be cut out of a jig 25. The jig 25 is a remainder of the recording medium 20 when the piece 24 of the recording medium is removed. The piece 24 has a shape of a circle which has an infinite number of axes of symmetry through the center M of the circle. Other arbitrary shapes may be envisioned to be cut, for example a rectangle, an ellipse, a circle, a polygon, etc.

Figure 3:
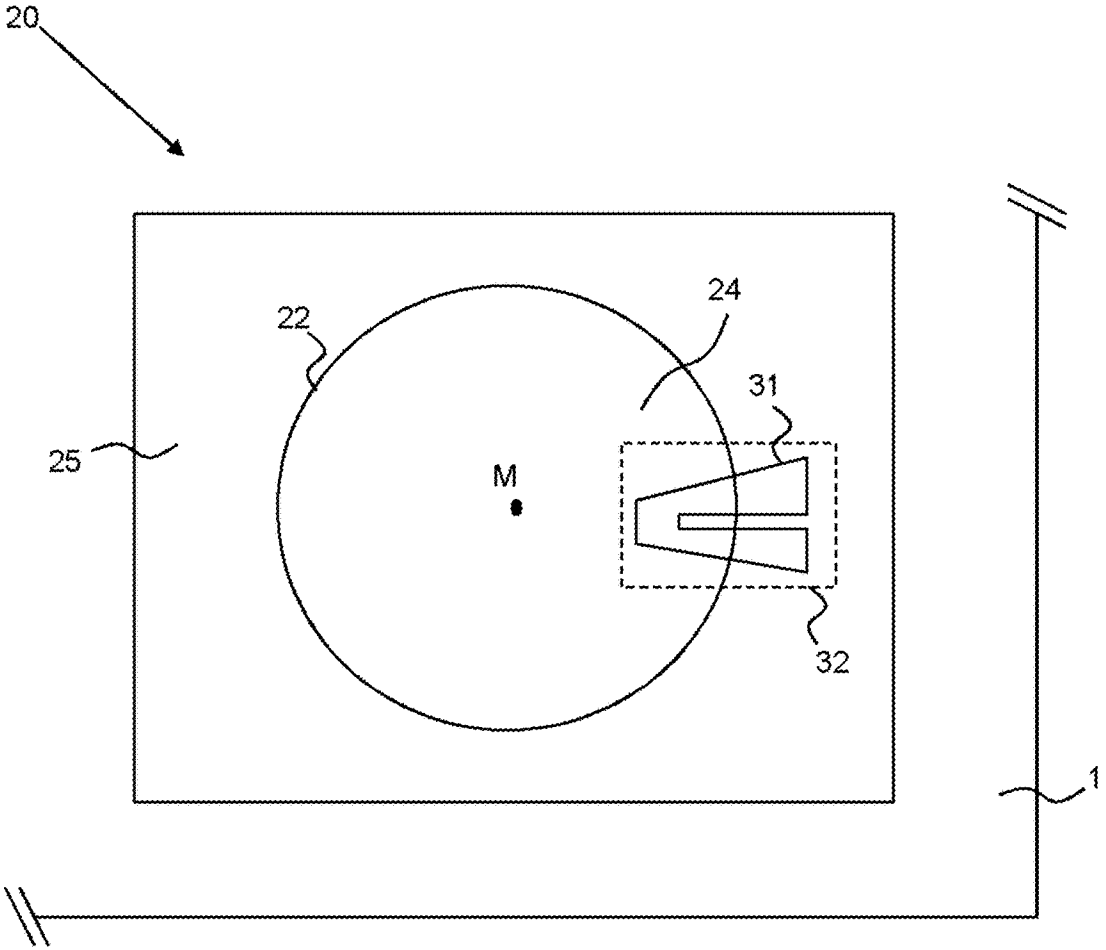
FIG. 3 is a schematic top view of the front side of the recording medium with a selected shape of an alignment mark at a determined location according to the invention.

FIG. 3 is a schematic top view of the front side of the recording medium 20 with a selected shape 31 of a first alignment mark at a determined first location according to the invention. The location 32 of the selected shape 31 is crossing the intended circular cut path 22 for the piece 24 of the recording medium to be cut out to the jig 25.

Figure 4:
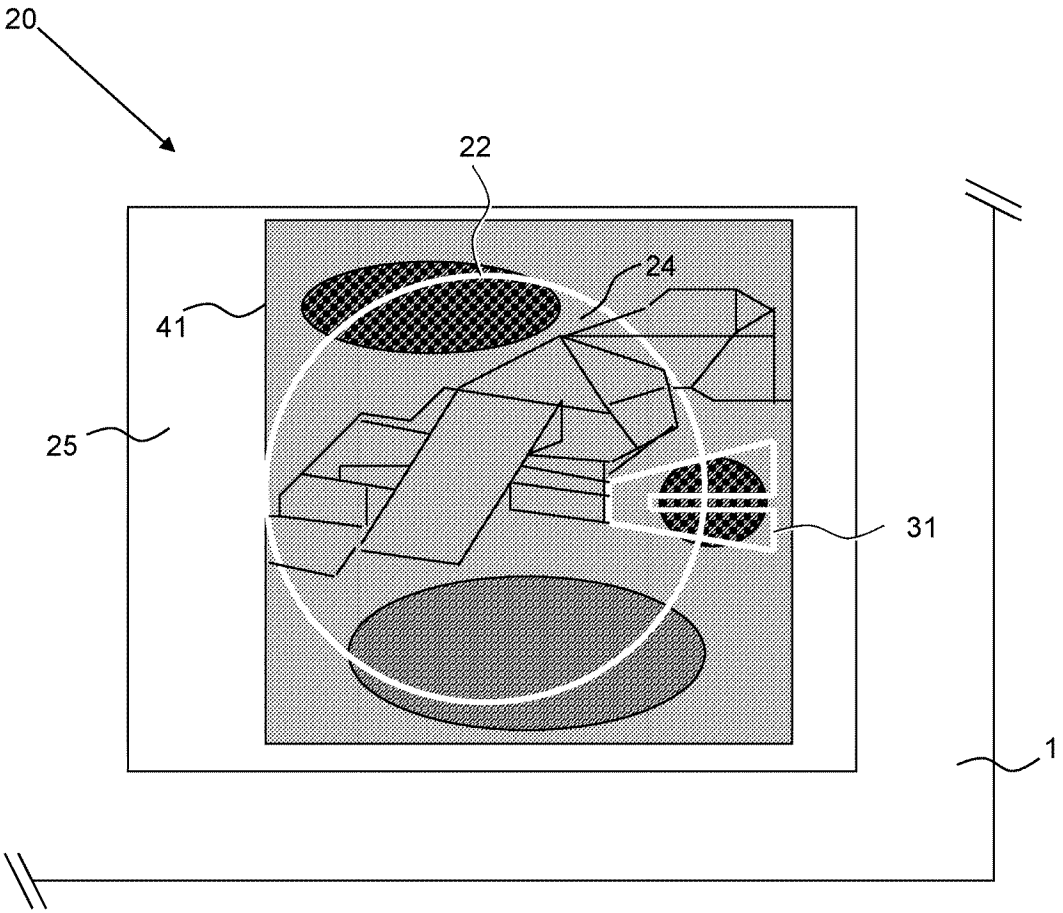
FIG. 4 is a schematic view of an image intended to be printed on the front side of the recording medium according to the invention.

FIG. 4 is a schematic view of an image 41 to be printed on the front side of the recording medium 20 according to the invention. The image 41 completely covers the piece 24 of the recording medium 20 and even areas of the jig 25 outside the intended cut path 22. An image which partially covers the piece 24 of the recording medium 20 may also be used for applying the method of the invention as long as the image is intended to be at least partially printed in a full bleed mode with respect to the intended cut path 22, i.e. as long as the image extends outside the cut path 22 on at least one location per intended alignment mark. The intended alignment mark with the selected shape 31 is indicated in the image 41. The intended cut path 22 and the selected shape 31 are presented in a white outline for convenience reasons.

Figure 5:
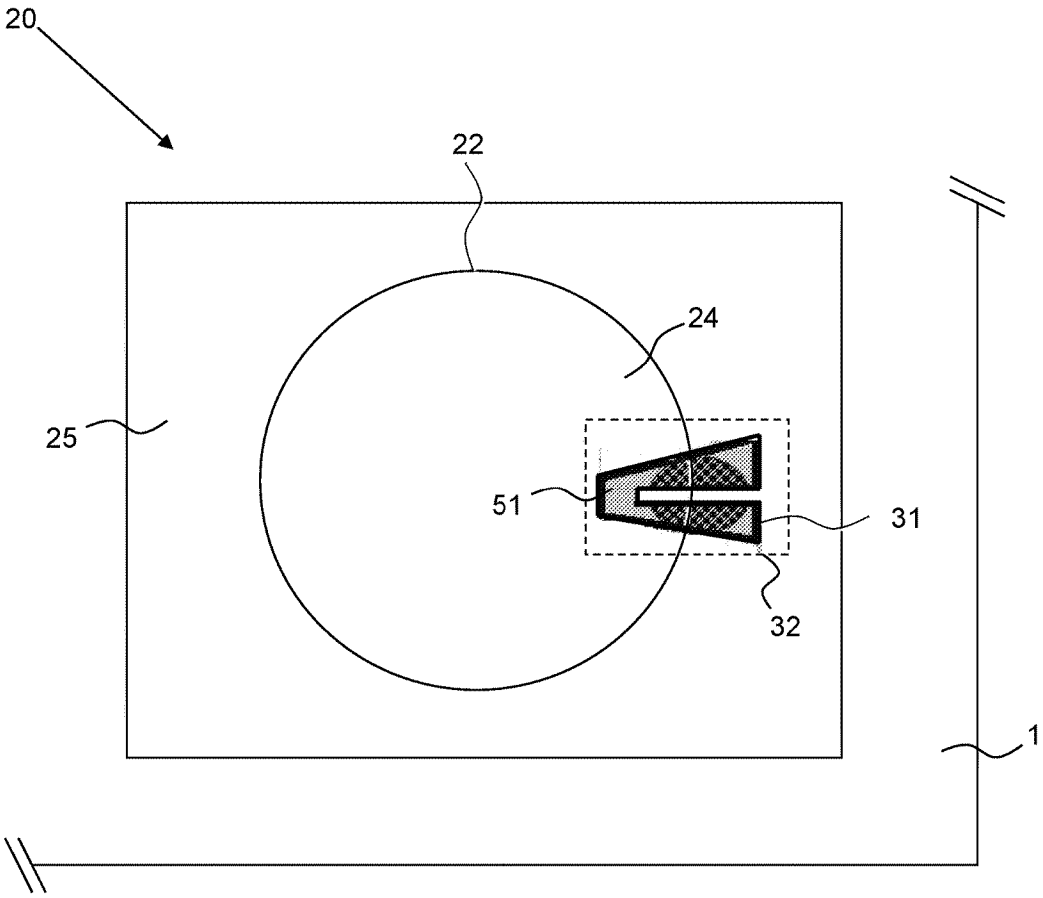
FIG. 5 is a schematic view of the front side of the recording medium with the first sub-image printed inside the first alignment mark on the piece of recording medium and on the jig according to the invention.

FIG. 5 is a schematic view of the front side of the recording medium 20 comprising an indication of the intended cut path 22 with the printed first alignment mark 31 crossing the cut path 22 from the piece 24 of the recording medium 20 to the jig 25. The shape 31 of the first alignment mark contains the corresponding printed sub-image 51 of the image 41, i.e. the sub-image 51 is printed on the location 32 of the planned alignment mark 31 in the image 41.

Situations illustrated in FIGS. 2-5 are also applied to a back side of the recording medium 20 after turning the recording medium 20 upside down on the medium supporting table 1. Analogue to the front side, on the back side of the recording medium 20 a second alignment mark is printed crossing the cut path 22.

Figure 6:
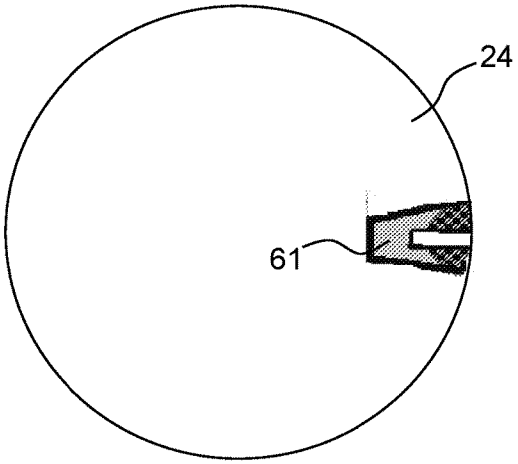
FIG. 6 is a schematic view of the front side of the piece of recording medium with a part of the printed first sub-image after the piece of the recording medium is cut out of the jig according to the invention.

FIG. 6 is a schematic view of the front side of the piece 24 when cut out of the recording medium 20 according to the cut path 22. The front side of the piece 24 comprises a part 61 of the printed first alignment mark 31 inside the piece 24 of the recording medium 20. On the back side of the cut piece 24 of the recording medium 20 a part of the printed second alignment mark is present. The second alignment mark is also printed before the piece 24 is cut out of the recording medium 20.

Figure 7:
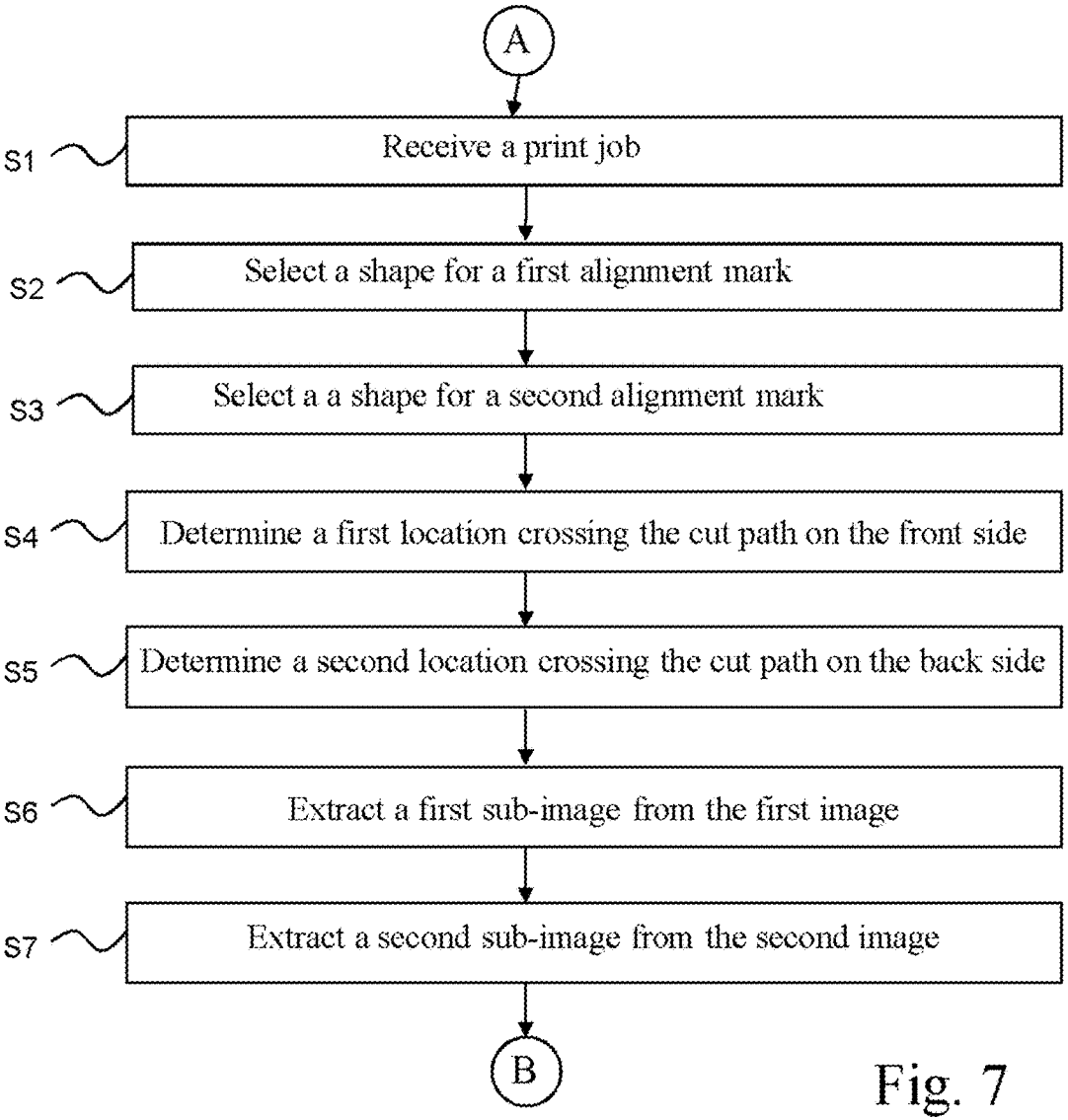
FIG. 7-8 is a flow diagram of a first embodiment of a method of operation of the flatbed printer assembly according to the present invention.
Figure 8:
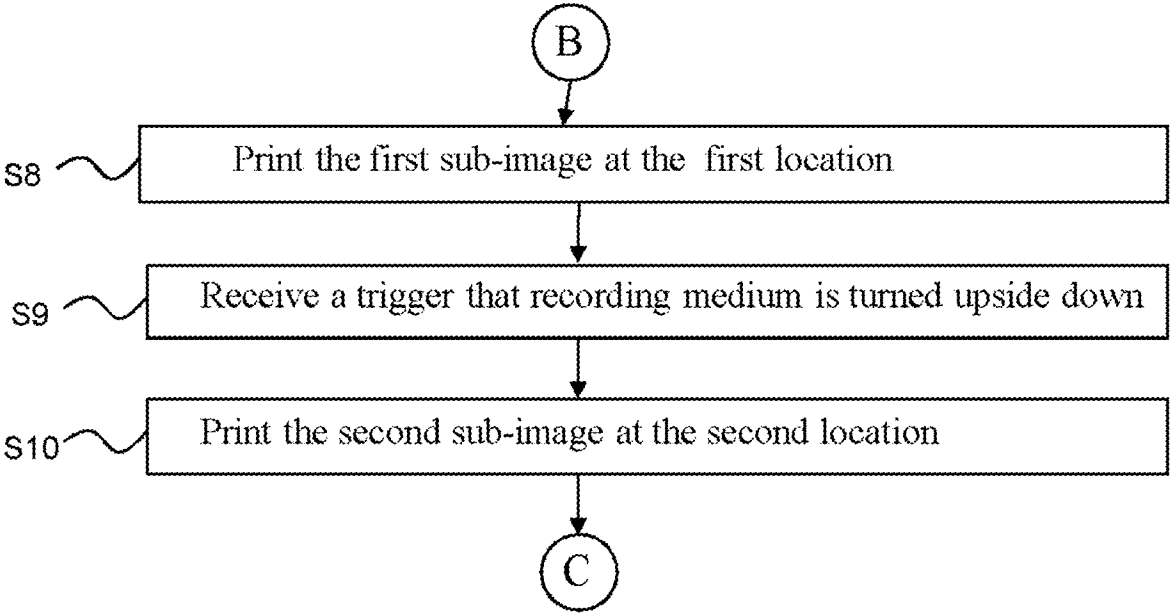

FIG. 7-8 is a flow diagram of a first embodiment of a method of operation of the flatbed printer assembly 14 according to the present invention.

The method starts in a starting point A. From the starting point A the method proceeds to a first step S1.

In the first step S1 a print job is received by the controller of the flatbed printer assembly 14. The print job includes a cut path intended to circumvent a piece of the recording medium which is intended to be cut out of the recording medium. The cut path may also be entered via the user interface of the flatbed printer assembly 14.

The print job also comprises a first image intended to be printed at least partially in a full bleed print mode on a front side of the piece of the recording medium, and a second image intended to be printed at least partially in a full bleed print mode on a back side of the piece of the recording medium.

In a second step S2 a shape for a first alignment mark for the first image is selected from a list of shapes stored in the controller memory.

In a third step S3 a shape for a second alignment mark for the second image is selected from the list of shapes stored in the controller memory.

In a fourth step S4 a first location on the front side of the recording medium is determined according to the selected shape of the first alignment mark such that the first location is crossing the cut path.

In a fifth step S5 a second location on the back side of the recording medium is determined according to the selected shape of the second alignment mark such that the second location is crossing the cut path.

In a sixth step S6 a first sub-image is extracted from the first image. The first sub-image is intended to be printed on the first location of the first alignment mark according to the first image.

In a seventh step S7 a second sub-image is extracted from the second image. The second sub-image is intended to be printed on the second location of the second alignment mark according to the second image.

Via an intermediate point B shown in FIG. 7 and FIG. 8 the method continues with an eighth step S8.

In the eighth step S8 the first sub-image is printed at the first location as being the first alignment mark.

In a ninth step S9 a trigger is received by the controller that the recording medium is turned upside down on the medium support table.

In a tenth step S10 the second sub-image is printed at the second location as being the second alignment mark.

The method ends in an endpoint C.

According to an embodiment the first and second sub-images are printed with an opacity in a percentage range from 100 percent to 10 percent. For example, if the first and second sub-image are printed with an opacity of 10 percent, the first and second sub-image are still suitable for aligning the front and back side of the piece 24 of recording medium 20 with the jig 25. The first and second sub-image are then printed with a percentage of 90 percent opacity together with the complete first and second images respectively when the first and second image are printed on the front and back side of the recording medium 20 respectively.

According to an alternative embodiment the first and second alignment marks are printed in another color with an opacity of less than 50 percent, the other color being different from the colors of the first and second sub-images. By doing so, the printed first and second alignment marks are still suitable for aligning the front and back side of the piece 24 of recording medium 20 with the jig 25. The first and second sub-image are then printed together with the complete first and second images respectively when the first and second image are printed on the front and back side of the recording medium 20 respectively.

According to an embodiment the first sub-image is completely located within the cut path. In that case the first sub-image is extended with a third image having a shape of the first alignment mark outside the circumvented piece 24 of the recording medium 20 before printing the first sub-image. The third image may be selected to have the same colors as the first sub-image.

Analogously, according to an embodiment the second sub-image is completely located within the cut path. In that case the second sub-image is extended with a fourth image having a shape of the second alignment mark outside the circumvented piece 24 of the recording medium 20 before printing the second sub-image. The fourth image may be selected to have the same colors as the second sub-image.

Figure 9:
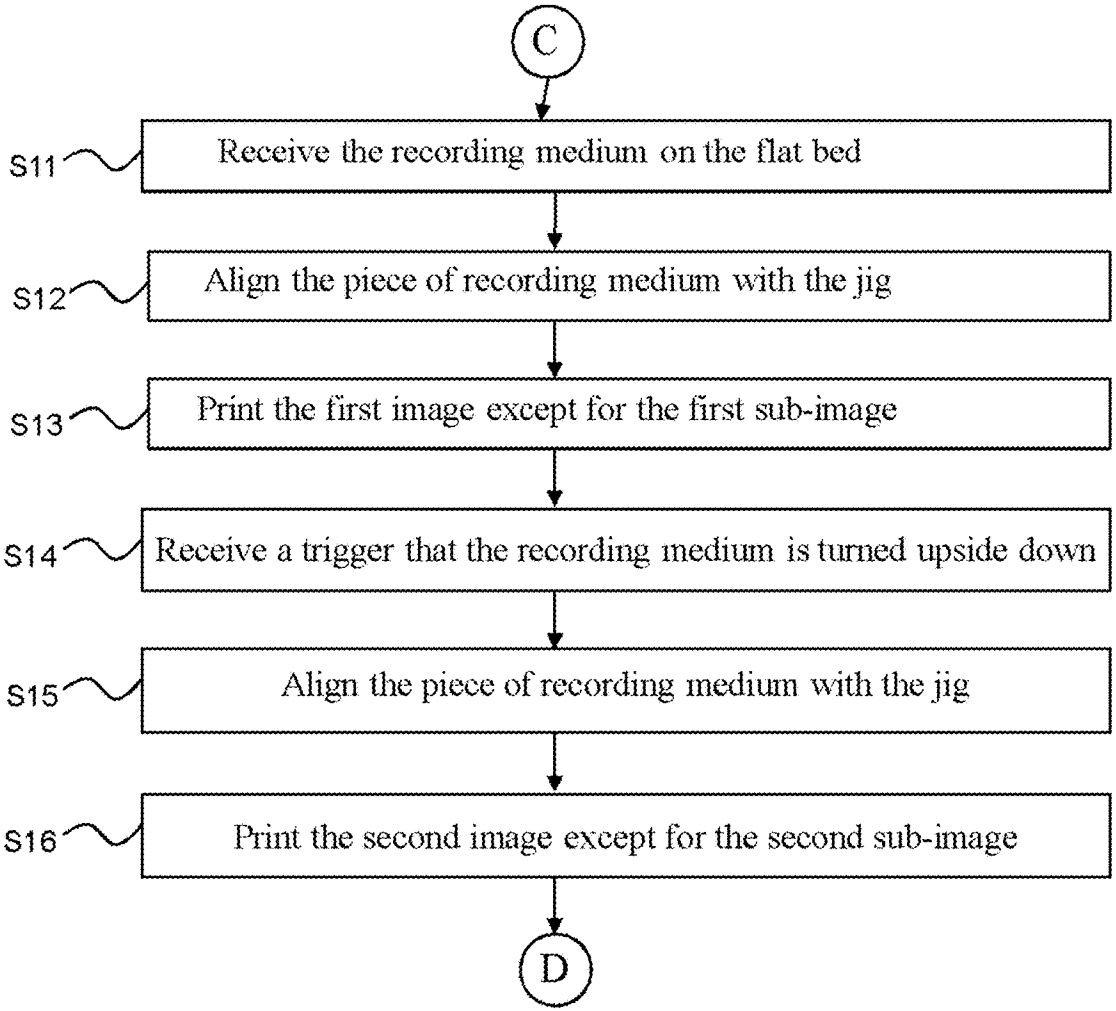
FIG. 9 is a flow diagram of a second embodiment of a method of operation of the flatbed printer assembly according to the present invention.

FIG. 9 is a flow diagram of a second embodiment of a method of operation of the flatbed printer assembly 14 according to the present invention.

The second embodiment comprises the steps S1-S10 of the first embodiment and starts at the end point C of the first embodiment with additional steps.

In an eleventh step S11 the recording medium 20 is received on the flatbed support table 1 with the front side on top after the printing of the first and second sub-image. The recording medium 20 is already cut along the cut path 22.

In a twelfth step S12 the piece 24 of the recording medium 20 is aligned with the remainder of the recording medium, i.e. the jig 25, by means of the printed first sub-image 51. The recording medium 20 itself may be also aligned on the flatbed support table 1 with a corner of the recording medium 20 to a corner or construction point of the flatbed support table 1.

In a thirteenth step S13 the first image 41 is printed on the front side of recording medium 20 except for the first sub-image 51, since the first sub-image 51 is already printed on the front side of the recording medium 20.

In a fourteenth step S14 a trigger is received that the recording medium 20 is turned upside down on the medium support table 1.

In a fifteenth step S15 the piece 24 of the recording medium 20 is aligned with the remainder of the recording medium, i.e. the jig 25, by means of the printed second sub-image. The recording medium 20 itself may be also aligned on the flatbed support table 1 with a corner of the recording medium 20 to a corner or construction point of the flatbed support table 1.

In a sixteenth step S16 the second image is printed on the recording medium 20 except for the second sub-image, since the second sub-image is already printed on the back side of the recording medium 20.

The method ends in an end point D.

According to an embodiment the step of printing the first image on the recording medium except for the first sub-image comprises the following sub-steps. Firstly a percentage of opacity of the printed first sub-image is determined. Secondly the first sub-image is printed on the cut recording medium to achieve a opacity of 100 percent when printing of the first sub-image is completed. Analogously, the step of printing the second image on the recording medium except for the second sub-image comprises the sub-steps of determining a percentage of opacity of the printed second sub-image and printing the second sub-image on the cut recording medium to achieve a opacity of 100 percent when printing of the second sub-image is completed.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A flatbed printer assembly, the flatbed printer assembly comprising:

a medium support table for supporting a recording medium, the table extending in a first direction and a second direction, the first direction being perpendicular to the second direction, a gantry arranged to be moveable over the medium support table in the first direction, a carriage support movably arranged on the gantry to move over the medium support table in the second direction, a carriage configured to be coupled to the carriage support and comprising a print head to eject marking material on the recording medium, and a controller for controlling the movements of the gantry, the carriage support and the print head while moving over the medium support table, wherein the controller is configured to:

a) receive a print job including a cut path intended to circumvent a piece of the recording medium, a first image intended to be printed on a front side of the piece of the recording medium, a second image intended to be printed on a back side of the piece of the recording medium, wherein at least one of the first and second image is intended to be printed at least partially in a full bleed print mode, b) select a shape for a first alignment mark for the first image, c) select a shape for a second alignment mark for the second image, d) determine a first location on the front side of the recording medium according to the selected shape of the first alignment mark, the first location crossing the cut path, e) determine a second location on the back side of the recording medium according to the selected shape of the second alignment mark, the second location crossing the cut path, f) extract a first sub-image from the first image which is intended to be printed on the first location of the first alignment mark, g) extract a second sub-image from the second image which is intended to be printed on the second location of the second alignment mark, h) print the first sub-image at the first location as being the first alignment mark, i) receive a trigger that the recording medium is turned upside down on the medium support table, j) print the second sub-image at the second location as being the second alignment mark, k) cut the recording medium along the cut path, and l) print the first image on the front side of the piece of the recording medium and the second image on the back side of the piece of the recording medium.

2. The flatbed printer assembly according to claim 1, wherein the flatbed printer assembly comprises a user interface and the controller is configured to request permission to execute steps b)- j) by means of user interaction via the user interface.

3. A method for printing on a recording medium by a flatbed printer assembly , the flatbed printer assembly comprising a medium support table for supporting the recording medium, the table extending in a first direction and a second direction, the first direction being perpendicular to the second direction, a gantry arranged to be moveable over the medium support table in the first direction, a carriage support movably arranged on the gantry to move over the medium support table in the second direction, a carriage configured to be coupled to the carriage support and comprising a print head to eject marking material on the recording medium, and a controller for controlling the movements of the gantry, the carriage support and the print head while moving over the medium support table, wherein the method comprises the steps of a) receiving a print job including a cut path intended to circumvent a piece of the recording medium, a first image intended to be printed at least partially in a full bleed print mode on a front side of the piece of the recording medium, and a second image intended to be printed at least partially in a full bleed print mode on a back side of the piece of the recording medium, b) selecting a shape for a first alignment mark for the first image, c) selecting a shape for a second alignment mark for the second image, d) determining a first location on the front side of the recording medium according to the selected shape of the first alignment mark, the first location crossing the cut path, e) determining a second location on the back side of the recording medium according to the selected shape of the second alignment mark, the second location crossing the cut path, f) extracting a first sub-image from the first image which is intended to be printed on the first location of the first alignment mark, g) extracting a second sub-image from the second image which is intended to be printed on the second location of the second alignment mark, h) printing the first sub-image at the first location as being the first alignment mark, i) receiving a trigger that the recording medium is turned upside down on the medium support table, j) printing the second sub-image at the second location as being the second alignment mark, k) cutting the recording medium along the cut path, and l) printing the first image on the front side of the piece of the recording medium and the second image on the back side of the piece of the recording medium.

4. The method according to claim 3, wherein the first and second sub-images are printed with an opacity in a percentage range from 100 percent to 10percent.

5. The method according to claim 3, wherein the first and second alignment marks are printed in another color with an opacity of less than 50 percent, the other color being different from the colors of the first and second sub-images.

6. The method according to claim 3, wherein the first sub-image is completely located within the cut path, and the method comprises the step of extending the first sub-image with a third image having a shape of the first alignment mark outside the circumvented piece of the recording medium before printing the first sub-image.

7. The method according to claim 3, wherein the second sub-image is completely located within the cut path, and the method comprises the step of extending the second sub-image with a fourth image having a shape of the second alignment mark outside the circumvented piece of the recording medium before printing the second sub-image.

8. The method according to claim 3, wherein the method comprises the steps of:

after the printing of the first and second sub-image, receiving the recording medium on the flatbed support table with the front side on top, the recording medium being cut along the cut path, aligning the piece of the recording medium with the remainder of the recording medium by means of the printed first sub-image, printing the first image on the recording medium except for the first sub-image, receiving a trigger that the recording medium is turned upside down on the medium support table, aligning the piece of the recording medium with the remainder of the recording medium by means of the printed second sub-image, and printing the second image on the recording medium except for the second sub-image.

9. Method according to claim 3, wherein the method comprises the steps of:

after the printing of the first and second sub-image, receiving the recording medium on the flatbed support table with the front side on top, the recording medium being cut along the cut path, aligning the piece of the recording medium with the remainder of the recording medium by means of the printed first sub-image, printing the first image on the recording medium except for the first sub-image, receiving a trigger that the recording medium is turned upside down on the medium support table, aligning the piece of the recording medium with the remainder of the recording medium by means of the printed second sub-image, and printing the second image on the recording medium except for the second sub-image, wherein the step of printing the first image on the recording medium except for the first sub-image comprises the sub-steps of determining a percentage of opacity of the printed first sub-image, printed in step h), and printing the first sub-image on the cut recording medium to achieve a opacity of 100percent when printing of the first sub-image is completed, and wherein the step of printing the second image on the recording medium except for the second sub-image comprises the sub-steps of determining a percentage of opacity of the printed second sub-image, printed in step j), and printing the second sub-image on the cut recording medium to achieve a opacity of 100 percent when printing of the second sub-image is completed.

10. A computer-program product embodied on a non-transitory data carrier and configured to execute the method according to claim 3 when executed on a processor.

* * * * *